United States Patent [19]

Emonet

[11] Patent Number: 4,461,204

[45] Date of Patent: Jul. 24, 1984

[54] ANTI-FREEZING DEVICE FOR PNEUMATIC TOOLS

[75] Inventor: Henri Emonet, Loire, France

[73] Assignee: Maco Meudon, France

[21] Appl. No.: 286,112

[22] Filed: Jul. 23, 1981

[30] Foreign Application Priority Data

Jul. 25, 1980 [FR] France ..... 80 16750

[51] Int. Cl.[3] ..... F01B 23/00; F01L 25/02

[52] U.S. Cl. ..... 91/55; 91/317; 173/DIG. 2; 181/230

[58] Field of Search ..... 91/55, 317; 181/230; 173/DIG. 2

[56] References Cited

U.S. PATENT DOCUMENTS 2,128,742 8/1938 Fuehrer ..... 173/DIG. 2
3,224,527 12/1965 Waldron ..... 181/230
4,189,917 2/1980 Gunning ..... 173/DIG. 2
4,303,133 12/1981 Godolphin ..... 173/DIG. 2

*Primary Examiner*—Paul E. Maslousky
*Attorney, Agent, or Firm*—Remy J. Van Ophem

[57] ABSTRACT

The invention concerns an anti-freezing device for pneumatic tools to avoid the immobilization of the striker piston because of freezing up. A thermally insulating sleeve, broken only at the level of the air exhaust apertures of the cylinder, separates the body of the hammer from an annular chamber into which the apertures open. An exhaust passage connects the annular chamber with the exterior and extends along the external wall of the exhaust silencer parallel to the striker piston. The exhaust silencer also is provided, above and below the annular chamber with two hermetically sealed chambers, which prevent the cooling of the naturally hot zones of the hammer by the air in the exhaust passage.

8 Claims, 2 Drawing Figures

ANTI-FREEZING DEVICE FOR PNEUMATIC TOOLS

BACKGROUND OF THE INVENTION

1. Field of the Invention

The present invention concerns an anti-freezing device for a pneumatically-controlled tool, 2. Description of the Prior Art It is known that the exhaust air of a pneumatic tool constitutes a source of cold air. The air, subject to a sudden pressure release, may reach a temperature in the range of −35° to −40° C. It is also known that the exhaust air cannot be ejected directly into the atmosphere because of the noise which would result. One must, therefore, pass the exhaust air through various baffles which are arranged around the body of the hammer. This arrangement gives rise to a rapid cooling of the body of the tool during operation. This rapid cooling may result in a freezing-up of the tool, causing immobilization of the piston of the apparatus and, consequentially, a temporary loss of service of the apparatus. Naturally, this disadvantage is mainly perceptible during cold spells, or when the compressed air is moist.

SUMMARY OF THE INVENTION

The object of the present invention is to provide an anti-freezing device able to avoid the inconveniences set forth above.

An anti-freezing device according to the present invention is provided for a tool having a main body, a piston moving in a cylinder chamber formed in the main body, a control distributor at the upper portion of the main body, air exhaust apertures opening laterally into the cylinder, and an exhaust silencer surrounding the main body.

According to the present invention, the air exhaust apertures open into at least one chamber of the silencer, which is separated from the body of the hammer by a sleeve of thermally insulating material open only in the area of the apertures.

The at least one chamber is connected to the ambient atmosphere by means of at least one exhaust passage, the walls of this exhaust passage extending away from the body of the hammer.

According to an additional characteristic of the present invention, the silencer is provided above and below the chambers with two hermetically sealed chambers. These chambers may, if required, be filled with an insulating product which prevents the cooling of the naturally hot zones of the body of the hammer and which are thus conducive to the heating of the cylinder by conduction. The heat comes from the said naturally hot zones above and below the air exhaust apertures and is conducted by the metallic mass of the body to the region of the air exhaust apertures.

BRIEF DESCRIPTION OF THE DRAWINGS

The attached drawing, given by way of non-limiting example, will allow the characteristics of the invention to be better understood.

DESCRIPTION OF THE PREFERRED EMBODIMENT

Figure 2:
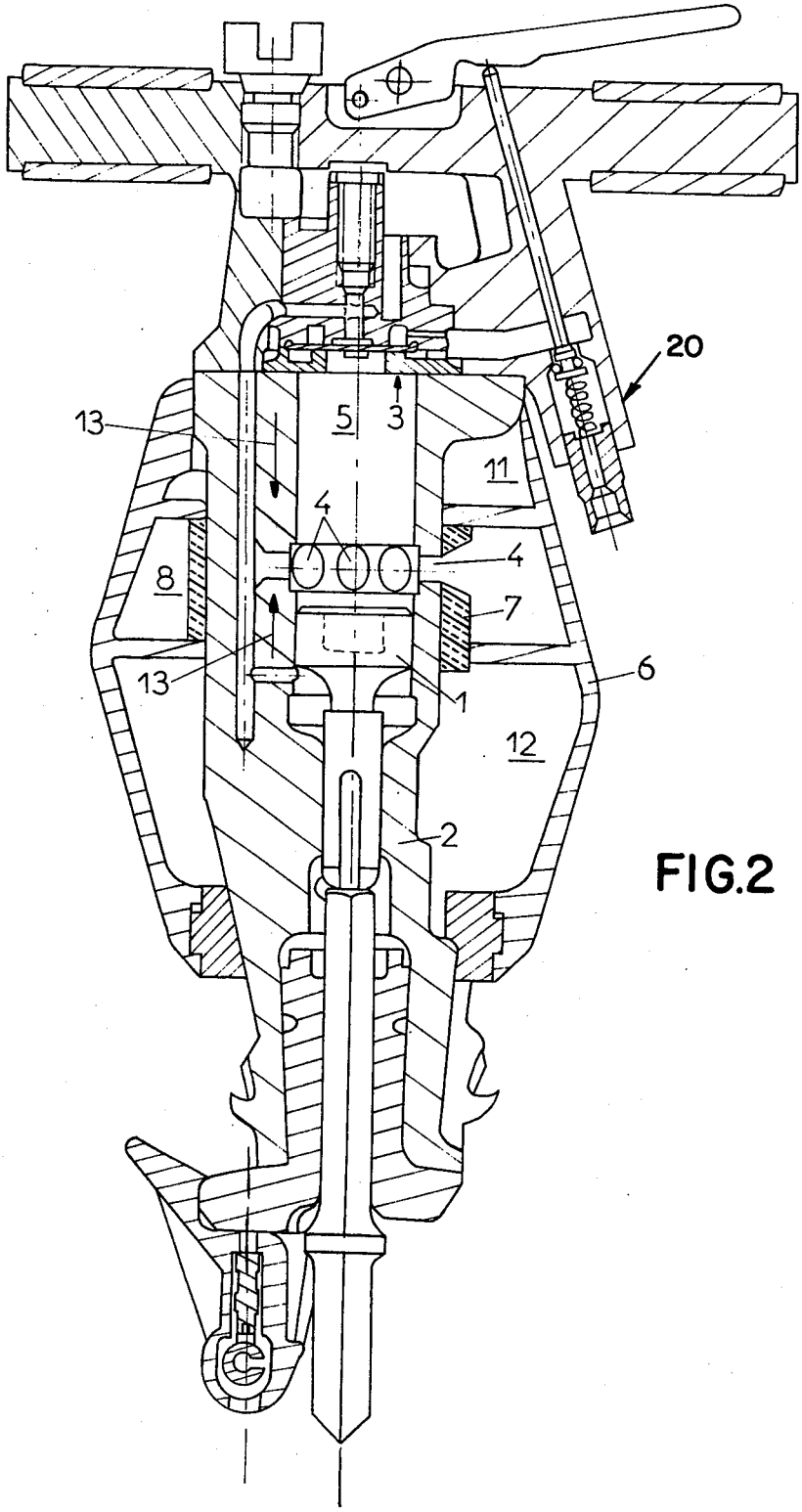
FIG. 2 is a cross-sectional view along line II—II of FIG. 1.

Referring now to the drawing, and more particularly to FIG. 2 thereof, a concrete-breaking hammer 20 is illustrated which, in the conventional way, includes a striker piston 1 sliding longitudinally in a cylindrical chamber 5 in a tool body 2. A conventional control distributor 3 is provided at the upper part of the tool body 2. Air exhaust apertures 4 open radially into the upper portion of the cylindrical chamber 5 of the tool body 2. The tool body 2 is surrounded throughout its height by an exhaust silencer 6.

Figure 1:
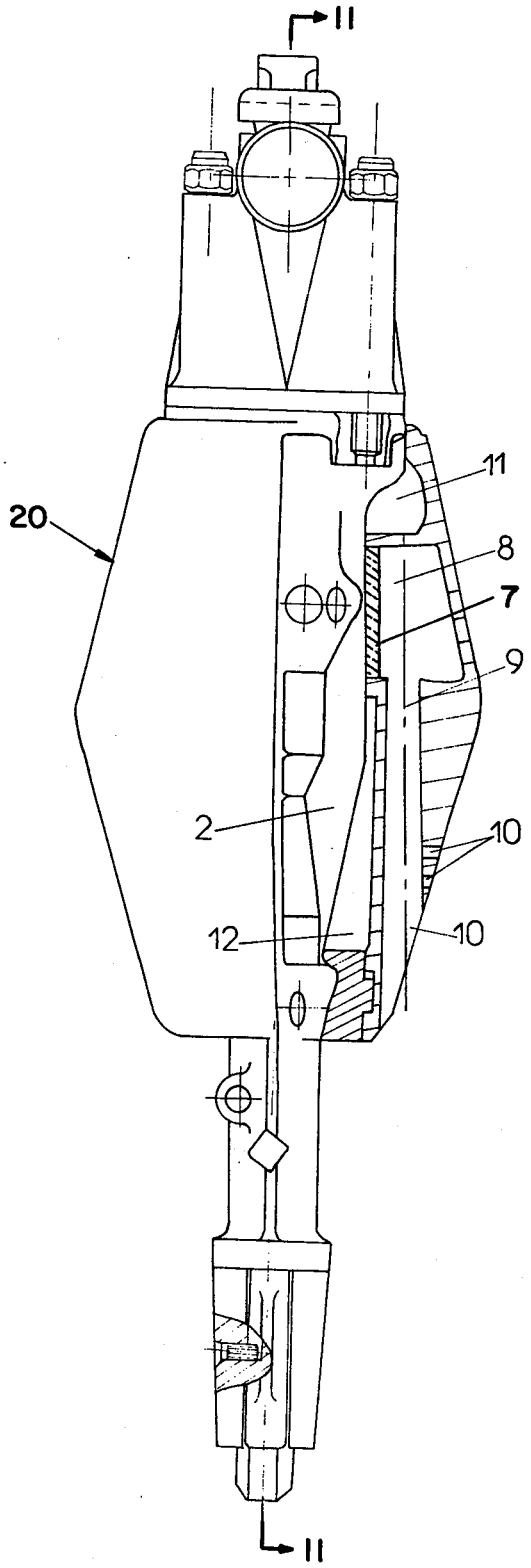
FIG. 1 is a partially cutaway side elevational view of a concrete-breaking hammer equipped according to the present invention.

According to an arrangement particular to the present invention, a sleeve of thermally insulating material 7, opening only at the level of the apertures 4, separates the tool body 2 from an annular chamber 8 in the exhaust silencer into which the apertures 4 open. The annular chamber 8 is also connected to the exterior by means of an exhaust channel or passage 9, as shown in FIG. 1, parallel to the major axis of the hammer. The exhaust channel 9 runs along the external wall of the silencer 6 and has a series of outlet apertures 10 close to the lower end of the silencer 6.

In addition, the silencer 6 forms two hermetically sealed annular chambers 11 and 12 disposed respectively above and below the annular chamber 8. It will be noticed that the hermetically sealed annular chamber 12 separates the exhaust channel 9 from the tool body 2 of the concrete-breaking hammer 20, as shown in FIG. 1.

The operation of the present invention is as follows:

The exhaust air leaves the apertures 4 at a temperature in the range of −35° to −45° C. when the machine is in use. The air is exhausted directly towards the exterior through baffles formed by the exhaust channel 9 without ever flowing in its path over the smallest metal surface. It is known, in fact, that the silencer 6 is itself made from a material which is strong, but non-metallic and a poor conductor of heat. This exhaust air, therefore, cannot cool the hammer.

In addition, the two hermetically sealed annular chambers 11 and 12 help to prevent the cooling of the naturally hot zones of the hammer by convection, thereby causing the heat originating from these naturally hot zones to flow directly, by conduction, into the metallic mass of the tool body 2 in the direction of the arrows 13 toward the central zone of the cylinder. That is, the heat flows to a region where it is desired to prevent cooling.

The concrete-breaking hammer, so equipped, is protected from any excessive cooling, and, consequently, from any phenomenon of freezing up, thereby avoiding immobilization of the piston 1 in the cylindrical chamber 5 of the tool body 2.

It will be noticed that the "direct" evacuation of the exhaust air towards the exterior may take place without harming the efficiency of the silencer, the exhaust circuit always having anti-noise baffles.

Naturally, the scope of the claims appended hereto will not be exceeded by arranging two exhaust channels 9, or even more, in the silencer, the essential element being that these channels remain separated from the tool body 2 of the hammer by the hermetically sealed chamber 12, as shown in FIG. 2.

What is claimed is:

1. An anti-freezing device for a pneumatic tool comprising a tool body, cylindrical cavity in said tool body, a piston movably disposed in said cylindrical cavity in said tool body, control distributor means interconnected with said cylindrical cavity, and exhaust apertures in said tool body, said exhaust apertures selectively interconnecting a portion of said cylindrical cavity with the ambient atmosphere, said anti-freezing device further comprising:

a sleeve of thermally insulating material wound around said tool body such as to surround at least said portion of said cylindrical cavity;

a silencer main body fitted over said tool body;

a first chamber in said silencer main body, said first chamber at least partially surrounding said portion of said cylindrical cavity;

opening means in said sleeve of thermally insulating material aligned with said exhaust apertures in said tool body such as to permit said cylindrical cavity to dispose of exhaust fluid therethrough into said first chamber in said silencer main body;

an exhaust channel formed in said silencer main body at a location remote from said tool body, said exhaust channel extending from said first chamber generally parallel to said cylindrical cavity and in a direction away from said control distributor means; and a second chamber formed in said silencer main body, said second chamber being disposed between said exhaust channel and said tool body, said second chamber further being hermetically sealed such as to insulate said tool body from being cooled by the fluid exhausted by said pneumatic tool.

2. The anti-freezing device of claim 1 wherein said first chamber comprises a first annular chamber completely surrounding said portion of said cylindrical cavity.

3. The anti-freezing device of claim 2 wherein said second chamber formed in said silencer main body comprises a second annular chamber disposed adjacent said first annular chamber.

4. An anti-freezing device for a pneumatic tool comprising a tool body, a cylindrical cavity in said tool body, a piston movably disposed in said cylindrical cavity in said tool body, control distributor means interconnected with said cylindrical cavity, and exhaust apertures in said tool body, said exhaust apertures selectively interconnecting a portion of said cylindrical cavity with the ambient atmosphere, said anti-freezing device further comprising:

a sleeve of thermally insulating material wound around said tool body such as to surround at least said portion of said cylindrical cavity;

a silencer main body fitted over said tool body;

a first annular chamber in said silencer main body, said first annular chamber at least partially surrounding said portion of said cylindrical cavity;

opening means in said sleeve of thermally insulating material aligned with said exhaust apertures in said tool body such as to permit said cylindrical cavity to dispose of exhaust fluid therethrough into said first annular chamber in said silencer main body;

an exhaust channel formed in said silencer main body at a location remote from said tool body, said exhaust channel extending from said first annular chamber generally parallel to said cylindrical cavity and in a direction away from said control distributor means;

a second annular chamber formed in said silencer main body, said second annular chamber being interposed said exhaust channel and said tool body, said second annular chamber further being hermetically sealed such as to insulate said tool body from being cooled by the fluid exhausted by said pneumatic tool; and a third annular chamber formed in said silencer main body, said third annular chamber being disposed adjacent said tool body and disposed between said control distributor means and said first annular chamber, said third annular chamber further being hermetically sealed such as to insulate said tool body from being cooled by the fluid exhausted by said pneumatic tool through said exhaust apertures.

5. The anti-freezing device of claim 4 wherein said silencer main body is formed of a material of low thermal conductivity.

6. The anti-freezing device of claim 1 wherein said second annular chamber formed in said silencer main body comprises an annular chamber disposed adjacent said first chamber.

7. The anti-freezing device of claim 1 further comprising:

a third chamber formed in said silencer main body, said third chamber comprising an annular chamber disposed adjacent said tool body and disposed between said control distributor means and said first chamber, said third chamber further being hermetically sealed such as to insulate said tool body from being cooled by the fluid exhausted by said pneumatic tool through said exhaust apertures.

8. The anti-freezing device of claim 1 wherein said silencer main body is formed of a material of low thermal conductivity.

* * * * *

UNITED STATES PATENT AND TRADEMARK OFFICE

CERTIFICATE OF CORRECTION

PATENT NO. : 4,461,204

DATED : July 24, 1984

INVENTOR(S) : Henri Emonet

It is certified that error appears in the above-identified patent and that said Letters Patent is hereby corrected as shown below:

Column 1, line 8, after "tool" delete the comma "," and insert the period ---- . ----.

Column 1, line 41, after "which" delete "is" and insert ---- are ----.

Column 1, line 54, delete "the said" and insert ---- the ----.

In The Claims

Column 2, line 68, delete "a tool body," and insert ---- a tool body, a ----.

Signed and Sealed this

*Seventh* Day of *May 1985*

[SEAL]

*Attest:*

DONALD J. QUIGG

*Attesting Officer*

*Acting Commissioner of Patents and Trademarks*